US008159151B2

(12) United States Patent
Imanaka

(10) Patent No.: US 8,159,151 B2
(45) Date of Patent: Apr. 17, 2012

(54) CONTROL CIRCUIT FOR INVERTER

(75) Inventor: Yoshinori Imanaka, Kyoto (JP)

(73) Assignee: Rohm Co., Ltd. (JP)

( * ) Notice: Subject to any disclaimer, the term of this patent is extended or adjusted under 35 U.S.C. 154(b) by 267 days.

(21) Appl. No.: 12/668,887

(22) PCT Filed: Jul. 4, 2008

(86) PCT No.: PCT/JP2008/001792

§ 371 (c)(1),
(2), (4) Date: Jan. 13, 2010

(87) PCT Pub. No.: WO2009/011097

PCT Pub. Date: Jan. 22, 2009

(65) Prior Publication Data

US 2010/0194310 A1 Aug. 5, 2010

(30) Foreign Application Priority Data

Jul. 18, 2007 (JP) ..... 2007-186794

(51) Int. Cl.
*G05F 1/00* (2006.01)

(52) U.S. Cl. ..... 315/308; 315/307; 315/291; 315/224; 315/209 R; 315/DIG. 4

(58) Field of Classification Search ..... 315/209 R, 315/224, 246, 276, 291, 307, 308, DIG. 4, 315/DIG. 7; 363/16, 21.07, 21.09, 21.11, 363/41, 95; 345/102
See application file for complete search history.

(56) References Cited

U.S. PATENT DOCUMENTS 6,239,558 B1 * 5/2001 Fujimura et al. ..... 315/307
6,285,138 B1 * 9/2001 Kataoka et al. ..... 315/291
6,864,644 B2 * 3/2005 Kernahan ..... 315/307
6,927,989 B2 * 8/2005 Fukumoto ..... 363/95
7,323,832 B2 * 1/2008 Fukumoto ..... 315/308
7,944,652 B2 * 5/2011 Fukumoto ..... 361/23

FOREIGN PATENT DOCUMENTS

JP 10-148808 A 6/1998
JP 2000-12276 A 1/2000
JP 2003-323994 A 11/2003
JP 2004-39298 A 2/2004
JP 2006-92858 A 4/2006

OTHER PUBLICATIONS

International Preliminary Examination Report on Patentability for International Application No. PCT/JP2008/001792 mailed Feb. 18, 2010 with English translation.
International Search Report for PCT/JP2008/001792 mailed Aug. 12, 2008 with English translation.

* cited by examiner

*Primary Examiner* — Haiss Philogene
(74) *Attorney, Agent, or Firm* — Cantor Colburn LLP

(57) ABSTRACT

A reference voltage source generates a reference voltage for adjusting an electric current for a dimming operation. The first current source generates a first current. A first current mirror circuit includes multiple output terminals, duplicates the first current, and outputs multiple first duplicated currents via the multiple output terminals. Multiple first switches are provided on paths for the respective multiple first duplicated currents. A converting resistor, with one terminal set to a fixed electric potential, is provided on a path for the multiple first duplicated currents output from the first current mirror circuit. A decoder circuit receives a control signal from an external circuit, and controls the ON/OFF operations of the multiple first switches. The reference voltage source outputs, as the reference voltage, a voltage that corresponds to a voltage drop that occurs at a converting resistor.

8 Claims, 4 Drawing Sheets

CONTROL CIRCUIT FOR INVERTER

This is a U.S. national stage application of International Application No. PCT/JP2008/001792, filed on 4 Jul. 2008. Priority under 35 U.S.C. §119(a) and 35 U.S.C. §365(b) is claimed from Japanese Application No. JP2007-186794, filed 18 Jul. 2007, the disclosure of which is also incorporated herein by reference.

BACKGROUND OF THE INVENTION

1. Field of the Invention

The present invention relates to an inverter which supplies driving voltage to a fluorescent lamp or the like, and particularly to a dimming control technique for adjusting the luminance of a fluorescent lamp.

2. Description of the Related Art

In recent years, liquid crystal display TVs, which provide a TV having a thin shape and a large size, are becoming popular as replacements for CRT-based TVs. Liquid crystal display TVs include multiple cold cathode fluorescent lamps (which will be referred to as "CCFLs" hereafter) or external electrode fluorescent lamps (which will be referred to as "EEFLs" hereafter) arranged on the back face of a liquid crystal panel on which video images are to be displayed, which are used as light-emitting backlights.

The CCFL or EEFL is driven using an inverter (DC/AC converter) which boosts DC voltage of around 12 V, and which outputs the voltage thus boosted in the form of AC voltage, for example. The inverter converts the current flowing through the CCFL into voltage, and returns the voltage thus converted to a control circuit as a feedback voltage, thereby controlling the ON/OFF operation of a switching element based upon this feedback voltage. For example, a CCFL driving technique using an inverter is disclosed in Patent document 1.

With such an arrangement, in some cases, in order to provide a dimming function, i.e., in order to adjust the luminance of a fluorescent lamp, the control circuit for the inverter has a dimming function. There are two types of dimming operations. One is a dimming operation set by a manufacturer that has designed an apparatus mounting a fluorescent lamp and an inverter, and the other is that set by the user when the user uses this apparatus. Examples of such dimming methods include an analog dimming control method (current dimming control method) in which the current flowing through the fluorescent lamp (which will be referred to as "lamp current" hereafter) is controlled, and a burst dimming control method in which the fluorescent lamp is controlled so as to provide intermittent light emission.

[Patent Document 1]

Japanese Patent Application Laid Open No. 2003-323994

The control circuit generates a pulse modulation signal with a duty ratio that changes according to an error voltage which is the difference between a feedback voltage that corresponds to the lamp current and a predetermined dimming reference signal so as to control the ON/OFF period of the switching voltage to be supplied to a transformer. In the analog dimming method, the lamp current is adjusted by changing the dimming reference voltage. In general, with conventional arrangements, a component external to the control circuit generates the dimming reference voltage in the form of an analog signal, and supplies the dimming reference voltage thus generated to the control circuit.

In some cases, in the analog dimming method, the luminance is switched in a discrete manner. In this case, there is a greater demand for relative precision of the luminance, rather than for absolute precision of the luminance. That is to say, such an arrangement requires relative precision among multiple dimming reference voltages on a voltage-level basis. In a case in which such multiple dimming reference voltages are generated at a circuit external to a control circuit as in conventional arrangements, it is difficult to generate the dimming reference voltages with high relative precision.

SUMMARY OF THE INVENTION

The present invention has been made in order to solve such a problem. Accordingly, it is a general purpose of the present invention to provide a control circuit for an inverter which is capable of adjusting the luminance with high relative precision.

An embodiment of the present invention relates to a control circuit for a driving inverter for a fluorescent lamp. The control circuit includes: a reference voltage source which generates a predetermined reference voltage; a pulse modulator which receives a feedback voltage that corresponds to the current flowing through the fluorescent lamp, and generates a pulse signal having a duty ratio adjusted such that the feedback voltage approaches the reference voltage; and a driver which drives a switching circuit according to the pulse signal so as to supply a switching voltage to a transformer provided in the form of a component external to the control circuit. The reference voltage source includes: a first current source which generates a first current; a first current mirror circuit which has multiple output terminals, which duplicates the first current, and outputs multiple first duplicated currents via the multiple output terminals; multiple first switches respectively provided on paths for the multiple first duplicated currents; a converting resistor, one terminal of which is set to a fixed electric potential, and which is provided on a path for the multiple first duplicated currents output from the first current mirror circuit; and a decoder circuit which receives a control signal from an external circuit, and controls the ON/OFF operations of the multiple first switches according to the control signal. With such an arrangement, the control circuit outputs, as the reference voltage, a voltage that corresponds to a voltage drop that occurs at the converting resistor.

With such an embodiment, the composite current obtained by combining the multiple first duplicated currents is adjusted in a discrete manner according to the mirror ratio. Accordingly, the voltage drop that occurs at the converting resistor is also controlled in a discrete manner. The mirror ratio of a current mirror circuit exhibits small relative irregularity. Thus, such an arrangement provides increased relative precision of the reference voltage, thereby allowing the dimming operation to be performed with high precision.

Also, the first current source may include: a first resistor, one terminal of which is set to a fixed electric potential; a first transistor, one terminal of which is connected to the other terminal of the first resistor; and a first operational amplifier, of which one input terminal is connected to the aforementioned other terminal of the first resistor, and the other input terminal is used to receive a predetermined reference voltage, and of which the output terminal is connected to the control terminal of the first transistor. Also, the first resistor and the converting resistor may be formed on a single semiconductor substrate in a pairing manner.

With such an arrangement, the resistance values of the first resistor and the second resistor change in association with each other. Accordingly, even if the resistance of the first resistor changes, leading to a change in the composite current obtained by combining the first duplicated currents, the resistance of the second resistor changes such that the change in composite current is canceled out. Thus, such an arrangement suppresses the absolute value of irregularity in each current, in addition to suppressing relative irregularity among these currents.

Also, the control circuit may further include: a second current source which generates a second current; a second current mirror circuit which has at least one output terminal, and which duplicates the second current, and outputs at least one second duplicated current via the output terminal; and at least one second switch provided on a path for at least one second duplicated current. Also, the second duplicated current may be supplied to the converting resistor. Also, the decoder circuit may control the ON/OFF operation of the second switch, in addition to the first switch.

With such an arrangement, by adjusting the second current, the degree of the dimming operation (dimming amount) can be changed.

Also, the second current mirror circuit may include two output terminals, and may be configured so as to generate two second duplicated currents. Also, one of the second duplicated currents may be generated in a direction that flows into the converting resistor. Also, the other of the second duplicated currents may be generated in a direction that flows out from the converting resistor.

With such an arrangement, by adjusting the second current, the ratio of the change in luminance with respect to the base luminance can be changed.

Also, the composite current obtained by combining the multiple first duplicated currents output from the first current mirror circuit may be adjusted by being switched among three current levels using the first switches. Also, the decoder circuit may be configured such that, when the composite current is to be set to a minimum value, the second switch, which is provided on a path for one of the second duplicated currents, is switched to the ON state, and when the composite current is to be set to a maximum value, the second switch, which is provided on a path for the other of the second duplicated currents, is switched to the ON state.

Also, the second current source may include: a second resistor, one terminal of which is set to a fixed electric potential; a second transistor, one terminal of which is connected to the other terminal of the second resistor; and a second operational amplifier, of which one input terminal is connected to the aforementioned other terminal of the second resistor, and the other input terminal receives a predetermined reference voltage, and of which the output terminal is connected to the control terminal of the second transistor. Also, the second resistor may be provided in the form of a chip component external to a semiconductor substrate on which the control circuit is formed.

Such an arrangement allows the ratio of the change in luminance with respect to the base luminance to be changed according to the resistance of the second resistor.

Another embodiment of the present invention relates to a light emitting apparatus. The light emitting apparatus includes: a fluorescent lamp; a transformer with a secondary coil connected to the fluorescent lamp; a feedback circuit which generates a feedback voltage that corresponds to the current that flows through the fluorescent lamp; and the above-described control circuit which receives a control signal and the feedback signal for adjusting the luminance of the fluorescent lamp, and which supplies the switching voltage to a primary coil of the transformer.

Such an embodiment allows the relative luminance of a fluorescent lamp to be adjusted with high precision.

Yet another embodiment of the present invention relates to a display apparatus. The display apparatus includes: a liquid crystal panel; the above-described light emitting apparatus which is arranged as a backlight on the back face of the liquid crystal panel; and a host processor which outputs a control signal to the light emitting apparatus in order to adjust the luminance of the fluorescent lamp.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
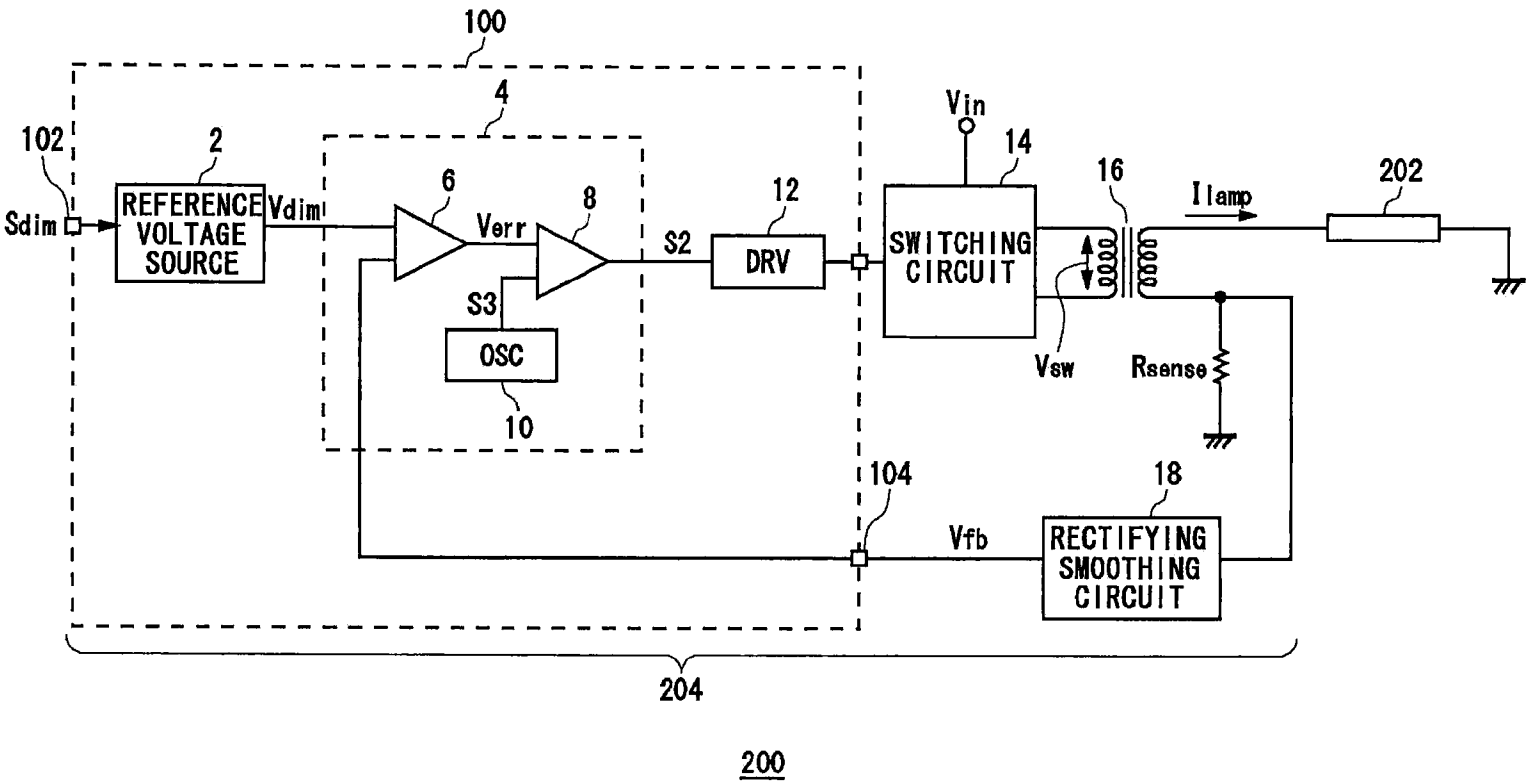
FIG. 1 is a circuit diagram which shows a configuration of a light emitting apparatus according to an embodiment of the present invention.

Description will be made below regarding preferred embodiments according to the present invention with reference to the drawings. The same or similar components, members, and processes are denoted by the same reference numerals, and redundant description thereof will be omitted as appropriate. The embodiments have been described for exemplary purposes only, and are by no means intended to restrict the present invention. Also, it is not necessarily essential for the present invention that all the features or a combination thereof be provided as described in the embodiments.

In the present specification, the state represented by the phrase "the member A is connected to the member B" includes a state in which the member A is indirectly connected to the member B via another member that does not affect the electric connection therebetween, in addition to a state in which the member A is physically and directly connected to the member B.

Figure 2:
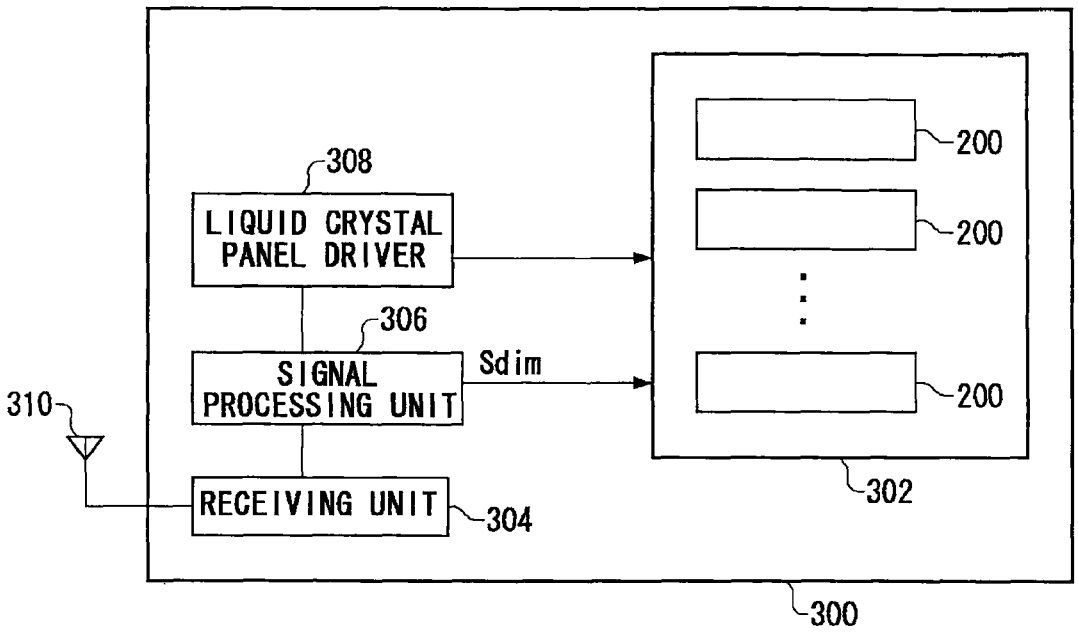
FIG. 2 is a block diagram which shows a configuration of a liquid crystal display TV mounting the light emitting apparatus shown in FIG. 1.

FIG. 1 is a circuit diagram which shows a configuration of a light emitting apparatus 200 according to an embodiment of the present invention. FIG. 2 is a block diagram which shows a configuration of a liquid crystal display TV 300 mounting the light emitting apparatus 200 shown in FIG. 1. The liquid crystal display TV 300 is connected to an antenna 310. The antenna 310 receives broadcast waves, and outputs a received signal to a reception unit 304. The reception unit 304 detects and amplifies the received signal, and outputs the received signal thus detected and amplified to a signal processing unit 306. The signal processing unit 306 demodulates the modulated data, and outputs the image data obtained by the demodulation to a liquid crystal panel driver 308. The liquid crystal panel driver 308 outputs the image data to a liquid crystal panel 302 in increments of scanning lines, thereby displaying video images and still images. Multiple light emitting apparatuses 200 are arranged as a backlight on the back face of the liquid crystal panel 302. The signal processing unit 306 outputs a dimming control signal Sdim in order to control the luminance of light emitted by the light emitting apparatuses 200 included in the liquid crystal display TV 300.

The light emitting apparatus 200 shown in FIG. 1 according to the present embodiment is preferably employed as a backlight for such a liquid crystal panel 302. Returning to FIG. 1, detailed description will be made regarding the configuration and the operation of the light emitting apparatus 200.

The light emitting apparatus 200 according to the present embodiment includes a lamp 202 and an inverter 204. The lamp 202 is arranged on the back face of the liquid crystal panel 302. The inverter 204 converts an input voltage Vin, which is provided in the form of DC voltage, into an AC voltage, boosts the AC voltage thus converted, and supplies the AC voltage thus boosted to the lamp 202. In FIG. 1, a single lamp 202 is shown. Also, multiple lamps 202 may be arranged in parallel. Description will be made below regarding a configuration of the inverter 204 according to the present embodiment.

The inverter 204 includes a switching circuit 14, a transformer 16, a detecting resistor Rsense, a rectifying smoothing circuit 18, and a control circuit 100.

The switching circuit 14 is an H-bridge circuit or a half-bridge circuit, which supplies, to the primary coil of the transformer 16, a switching voltage Vsw adjusted based upon a driving signal S1 received from the control circuit 100. The secondary coil of the transformer 16 is connected to the lamp 202 which is to be driven. The detecting resistor Rsense is provided on a path for the lamp current which flows through the lamp 202, and generates a detected voltage Vsense that corresponds to the lamp current. The rectifying smoothing circuit 18 rectifies and smoothes the detected voltage Vsense, so as to generate a feedback voltage Vfb in proportion to the amplitude of the lamp current. The feedback voltage Vfb is input to a feedback terminal 104 of the control circuit 100.

In order to switch the luminance of the lamp 202 among three luminance levels, the light emitting apparatus 200 according to the present embodiment switches a lamp current Ilamp among three current levels. In order to provide stable luminance, the control circuit 100 according to the present embodiment performs a feedback control operation such that the feedback voltage Vfb that corresponds to the lamp current Ilamp matches a dimming reference voltage Vdim.

The control circuit 100 receives a dimming control signal Sdim, which indicates the luminance to be set, from the signal processing unit 306 shown in FIG. 2 that serves as a host processor. The dimming control signal Sdim is a 2-bit digital signal. The control circuit 100 switches the dimming reference voltage Vdim among three voltage levels according to the dimming control signal Sdim.

The control circuit 100 includes a reference voltage source 2, a pulse modulator 4, and a driver 12. The reference voltage source 2 generates the dimming reference voltage Vdim according to the dimming control signal Sdim. The dimming reference voltage Vdim is switched among a first reference value V1 which is used as a base voltage, a second reference value V2 which is relatively $\alpha$ % greater than the first reference value V1, and a third reference value V3 which is relatively $\beta$ % smaller than the first reference value V1.

The pulse modulator 4 receives the feedback voltage Vfb that corresponds to the lamp current Ilamp, and generates a pulse signal S2 having a duty ratio adjusted such that the feedback voltage Vfb approaches the dimming reference voltage Vdim. The pulse modulator 4 is a pulse width modulator including an error amplifier 6, a PWM comparator 8, and an oscillator 10. The error amplifier 6 amplifies the difference between the feedback voltage Vfb and the dimming reference voltage Vdim, thereby generating an error voltage Verr. The oscillator 10 generates a cyclic signal S3 in the shape of a triangular waveform or a sawtooth waveform. The PWM comparator 8 compares the cyclic signal S3 with the error voltage Verr, and slices the cyclic signal S3 using the error voltage Verr. As a result, the pulse signal S2 is generated, the level of which switches between the high state and the low state at each point of intersection of these two voltage signal curves. The pulse width of the pulse signal S2 changes according to the magnitude of the error voltage Verr.

The driver 12 drives the switching circuit 14 according to the pulse signal S2 so as to supply the switching voltage Vsw to the primary coil of the transformer 16.

Figure 3:
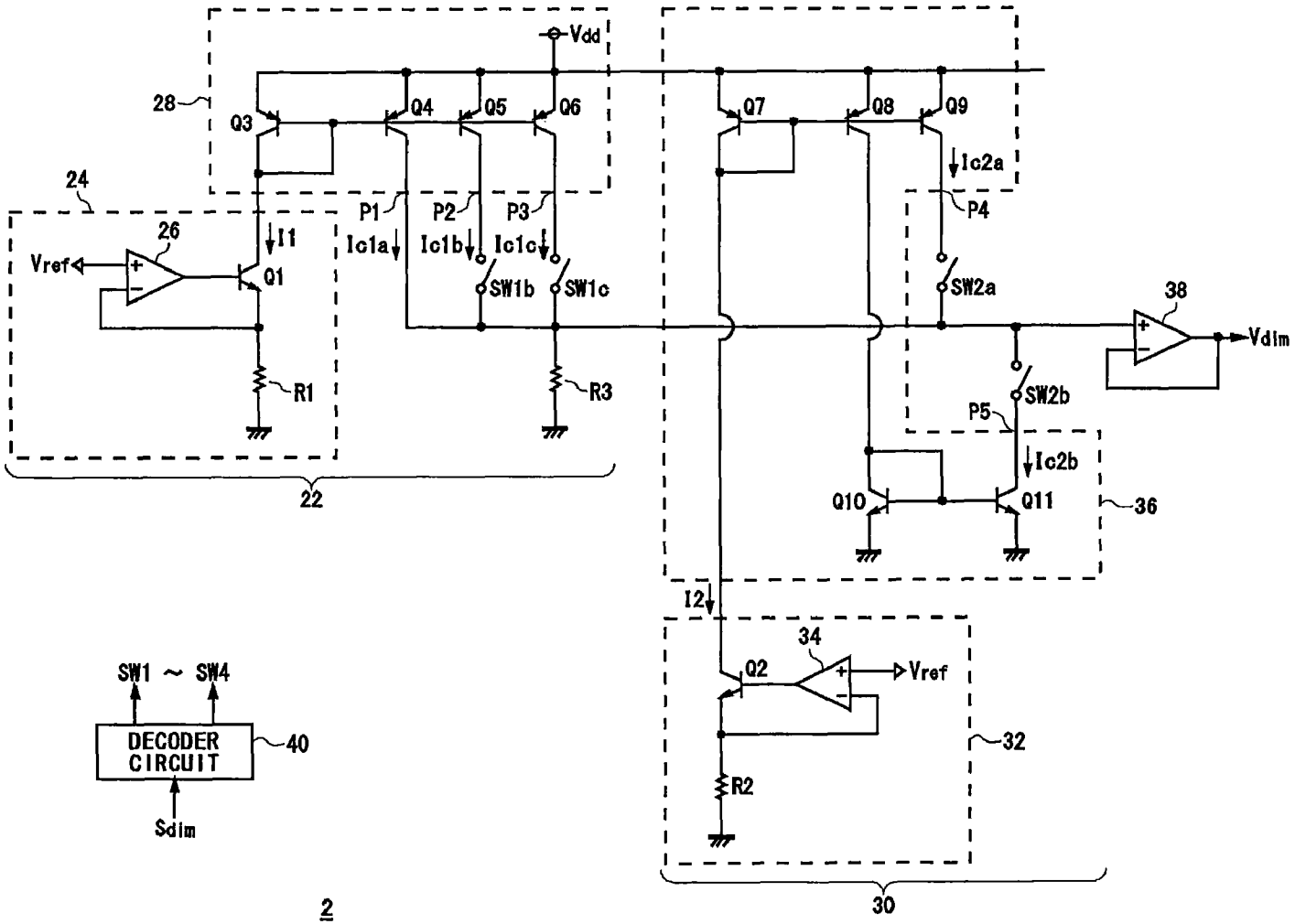
FIG. 3 is a circuit diagram which shows a configuration of a reference voltage source which generates a dimming reference voltage.

FIG. 3 is a circuit diagram which shows the configuration of the reference voltage source 2 which generates the dimming reference voltage Vdim. The reference voltage source 2 includes a dimming voltage generating unit 22, a dimming voltage correction unit 30, a decoder circuit 40, and a buffer circuit 38.

The dimming voltage generating unit 22 generates the dimming reference voltage Vdim. The dimming voltage generating unit 22 includes a first current source 24, a first current mirror circuit 28, multiple first switches SW1*b* and SW1*c*, and a converting resistor R3.

The first current source 24 generates a first current I1. The first current mirror circuit 28 includes multiple output terminals P1 through P3. The first current mirror circuit 28 duplicates the first current I1, and outputs multiple first duplicated currents Ic1*a* through Ic1*c* via the multiple output terminals P1 through P3. The first current mirror circuit 28 includes PNP bipolar transistors Q3 through Q6 with the base terminals thereof connected to each other so as to form a common base terminal, and with the emitter terminals thereof connected to each other so as to form a common emitter terminal. The transistor Q3 is provided on a path through which the first current I1 flows. The duplicated currents Ic1*a* through Ic1*c*, each of which is obtained by duplicating the first current I1, flow through the transistors Q4 through Q6, respectively. The current values of the duplicated currents Ic1*a* through Ic1*c* are determined based upon the size ratios of the transistors Q3 through Q6.

The multiple first switches SW1*b* and SW1*c* are provided on the paths for the respective multiple first duplicated currents Ic1*a* through Ic1*c*.

The converting resistor R3, one terminal of which is set to a fixed voltage, is provided on a path for the multiple first duplicated currents Ic1*a* through Ic1*c* output from the first current mirror circuit 28. A voltage drop occurs at the converting resistor R3, in proportion to the composite current obtained by combining the first duplicated currents Ic1*a* through Ic1*c*. The reference voltage source 2 outputs this voltage drop as the dimming reference voltage Vdim.

The decoder circuit 40 receives the dimming control signal Sdim, and controls the ON/OFF operations of the first switches SW1*b* and SW1*c* based upon the dimming control signal Sdim thus received. The decoder circuit 40 controls the first switches SW1*b* and SW1*c* according to the luminance set by the dimming control signal Sdim as follows.

(1) normal-state luminance

SW1*b*: ON state, SW1*c*: OFF state, composite current: Ic1*a*+Ic1*b*

(2) maximum luminance (α % raised)

SW1*b*: OFF state, SW1*c*: ON state, composite current: Ic1*a*+Ic1*c*

(3) minimum luminance (β % lowered)

SW1*b*: OFF state, SW1*c*: OFF state, composite current: Ic1*a*

Such an arrangement switches the composite current among three current levels according to a combination of the ON/OFF states of the first switches SW1*b* and SW1*c*. Thus, the dimming reference voltage Vdim can be switched among three voltage levels.

In a case in which the transistors Q3 through Q6 included in the first current mirror circuit 28 are formed in a pairing manner, such an arrangement exhibits exceedingly small irregularity in the mirror ratio. Thus, such an arrangement suppresses relative irregularity in the duplicated currents Ic1*a*, Ic1*b*, and Ic1*c*.

The following relation exists among α, β, and the duplicated currents Ic1*a* through Ic1*c*.

$$1+\alpha/100=(Ic1a+Ic1c)/(Ic1a+Ic1b)$$

$$1-\beta/100=Ic1a/(Ic1a+Ic1b)$$

Accordingly, α and β are maintained at constant values by maintaining the ratio among Ic1*a* through Ic1*c*. That is to say, the control circuit 100 according to the present embodiment is capable of adjusting the relative luminance with high precision.

Furthermore, the reference voltage source 2 shown in FIG. 3 has the following feature. The first current source 24 includes a first operational amplifier 26, a first resistor R1, and a first transistor Q1.

The first resistor R1 is provided with one terminal set to a fixed voltage. The first transistor Q1 is an NPN bipolar transistor with the emitter connected to the other terminal of the first resistor R1. The inverting input terminal of the first operational amplifier 26 is connected to the other terminal of the first resistor R1. A predetermined reference voltage Vref is input to the non-inverting input terminal of the first operational amplifier 26. The output terminal of the first operational amplifier 26 is connected to the control terminal (base) of the first transistor Q1.

The first current source 24 generates the first current I1 which is represented by the following Expression: I1=Vref/R1.

The first resistor R1 and the converting resistor R3 are preferably formed on a common semiconductor substrate in a pairing manner (a layout in which these components are arranged close to one another). Such an arrangement suppresses irregularities in the dimming reference voltage Vdim. Description will be made regarding the reason for this. In a case in which the first resistor R1 and the converting resistor R3 are formed in a paring manner, the resistances of these two resistors change at the same ratio with respect to the respective design values. Now, description will be made assuming that each of the resistances of the first resistor R1 and the converting resistor R3 becomes γ times its design value.

In this case, the first current I1 becomes 1/γ times its design value. The first current mirror circuit 28 duplicates the first current I1 which is 1/γ times its design value. Accordingly, each of the duplicated currents Ic1*a* through Ic1*c* is 1/γ times its design value. As a result, the composite current obtained by combining the duplicated currents Ic1 is also 1/γ times its design value.

Here, the voltage drop that occurs at the converting resistor R3 is represented by the product of the composite current obtained by combining the duplicated currents and the resistance of the converting resistor R3. The resistance of the converting resistor R3 is γ times its design value. Accordingly, the voltage drop is represented by γ×1/γ=1. That is to say, irregularities in the resistances are canceled out.

Thus, the reference voltage source 2 shown in FIG. 3 suppresses irregularities in the absolute value of the dimming reference voltage Vdim, in addition to irregularities in the relative value thereof.

Also, a modification may be made in which the first resistor R1 is provided in the form of an external resistor. With such a modification, the value of the first current I1 can be adjusted to a desired value, thereby allowing the value of the dimming reference voltage Vdim to be adjusted.

Furthermore, it is a feature of the reference voltage source 2 shown in FIG. 3 that it includes the dimming voltage correction unit 30. The dimming voltage correction unit 30 is provided in order to correct the aforementioned constants α and β. The dimming voltage correction unit 30 includes a second current source 32, a second current mirror circuit 36, and second switches SW2*a* and SW2*b*.

The reference voltage source 2 generates a second current I2. The second current mirror circuit 36 includes two output terminals P4 and P5. The second current mirror circuit 36 duplicates the second current I2, and outputs second duplicated currents Ic2*a* and Ic2*b* via the output terminals P4 and P5. The second current mirror circuit 36 includes transistors Q7 through Q11.

The second switches SW2*a* and SW2*b* are provided on the paths for the respective second duplicated currents Ic2*a* and Ic2*b*. The second duplicated currents Ic2*a* and Ic2*b* are supplied to the converting resistor R3. The decoder circuit 40 controls the ON/OFF operations of the second switches SW2*a* and SW2*b*, in addition to the first switches SW1*b* and SW1*c*.

The second duplicated current Ic2*a*, which is one of the second duplicated currents, is generated in the direction that flows into the converting resistor R3. The other second duplicated current, i.e., Ic2*b*, is generated in the direction that flows out from the converting resistor R3.

The second duplicated currents Ic2*a* and Ic2*b* are combined with the first duplicated currents Ic1*a* through Ic1*c*. When the luminance is to be set to the minimum luminance, the decoder circuit 40 switches the second switch SW2*a*, which is provided on the path for the second duplicated current Ic2*a* which is one of the second duplicated currents, to the ON state. When the luminance is to be set to the maximum luminance, the decoder circuit 40 switches the second switch SW2*b*, which is provided on the path for the other second duplicated current Ic2*b*, to the ON state.

That is to say, in a case in which the dimming voltage correction unit 30 is provided, such a circuit provides the following states.

(1) normal-state luminance

SW1*b*: ON state, SW1*c*: OFF state, SW2*a*: OFF state, SW2*b*: OFF state, composite current: Ic1*a*+Ic1*b*

(2) maximum luminance (α % raised)

SW1*b*: OFF state, SW1*c*: ON state, SW2*a*: ON state, SW2*b*: OFF state, composite current: Ic1*a*+Ic1*c*+Ic2*a*

(3) minimum luminance (β % lowered)

SW1*b*: OFF state, SW1*c*: OFF state, SW2*a*: OFF state, SW2*b*: ON state, composite current: Ic1*a*−Ic2*b*

The second current source 32 includes a first resistor R1, a second transistor Q2, and a second operational amplifier 34, and has the same configuration as that of the first current source 24. The second current source 32 generates the second current I2 represented by the following Expression: I2=Vref/R2. The second resistor R2 is provided in the form of a chip component.

In a case in which such an arrangement does not include the dimming voltage correction unit 30, 12 equals zero, and accordingly, Ic1*b* and Ic2*b* are each zero. Accordingly, as described above, α and β are set according to the mirror ratio of the first current mirror circuit 28.

The second duplicated current Ic2*a* affects the value of α. The value of α is increased according to the magnitude of Ic2*a*. Furthermore, the second duplicated current Ic2*b* affects the value of β. The value of β is increased according to the magnitude of Ic2*b*.

By providing the dimming voltage correction unit 30 in order to adjust the value of the second current I2, such an arrangement allows the values of α and β to be adjusted. The value of the second current I2 can be adjusted by changing the resistance of the second resistor R2.

Figure 4:
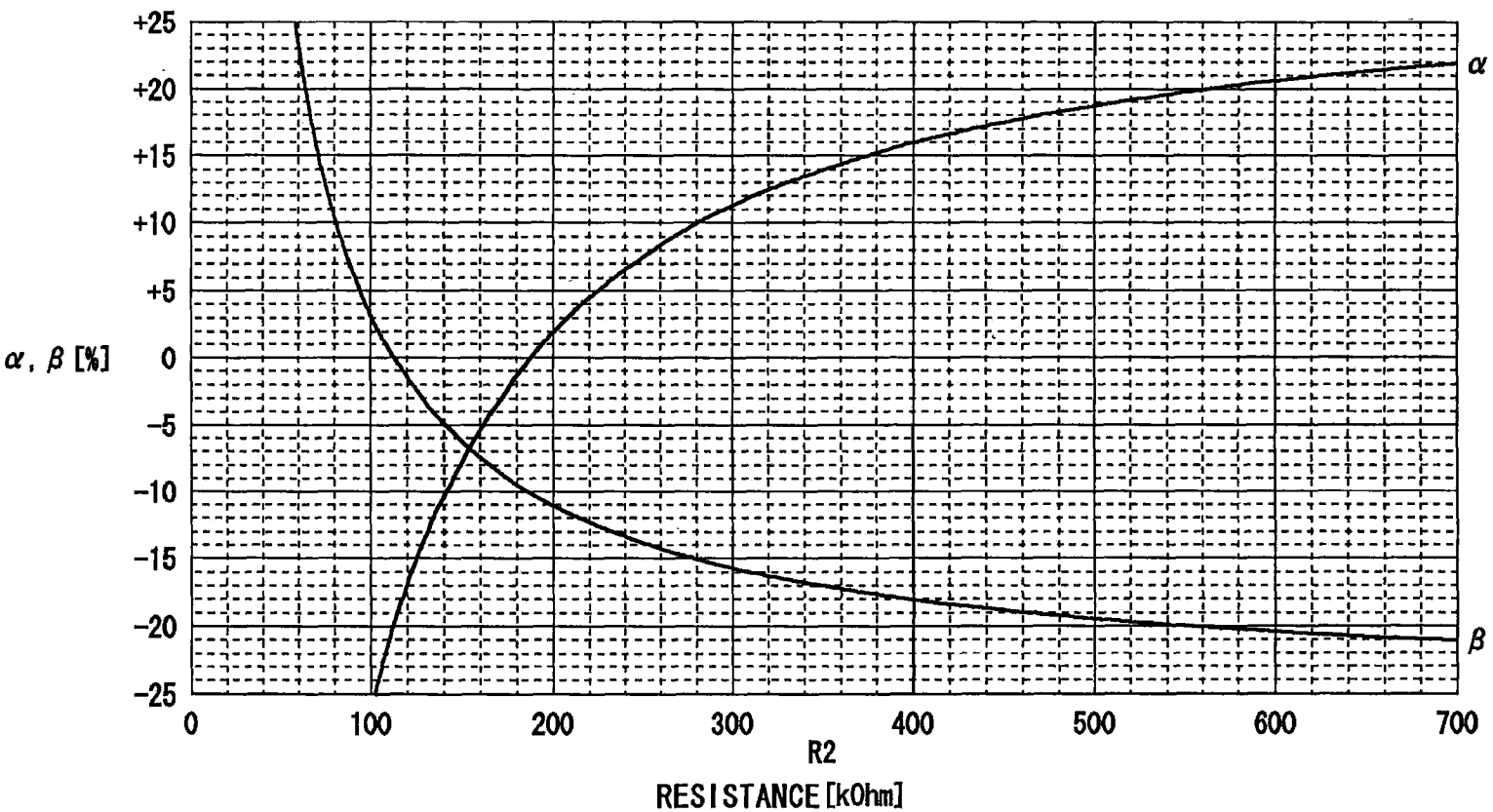
FIG. 4 is a diagram which shows a relation between the resistance of a second resistor and $\alpha$ and $\beta$.

FIG. 4 is a diagram which shows the relation between the resistance of the second resistor R2 and the values of α and β. In a case in which the resistance R2 reaches infinity, I2 becomes zero. Accordingly, in this case, the adjustment of the dimming amount cannot be further performed using the dimming voltage correction unit 30. In FIG. 4, the values of the vertical axis and the horizontal axis are shown for exemplary purpose only.

In the example shown in FIG. 4, for example, when the second resistor R2 is set to 280 kΩ, α and β are set to 10% and −15%, respectively. When the second resistor R2 is set to 560 kΩ, α and β are set to 20% and −20%, respectively. As described above, by providing the dimming voltage correction unit 30, such an arrangement allows the dimming amount to be changed. It should be noted that the curve shown in FIG. 4 can be modified as desired according to the mirror ratio of the current mirror circuit. In other words, the mirror ratios of the first current mirror circuit 28 and the second current mirror circuit 36 should be set so as to provide a desired curve.

The above-described embodiments have been described for exemplary purposes only, and are by no means intended to be interpreted restrictively. Rather, it can be readily conceived by those skilled in this art that various modifications may be made by making various combinations of the aforementioned components or processes, which are also encompassed in the technical scope of the present invention.

Description has been made in the embodiment regarding an arrangement in which the dimming amount is switched among three dimming levels. However, the present invention is not restricted to such an arrangement. The number of dimming levels can be set by adjusting the number of first duplicated currents Ic generated by the first current mirror circuit 28.

Also, a first switch may be provided on a path for any one of the multiple first duplicated currents Ic. For example, the first switch may be provided for each of the first duplicated currents Ic. Also, the ON/OFF operations of the first switches should be controlled such that the composite current obtained by combining the first duplicated currents Ic corresponds to a desired luminance provided by the buffer circuit 38.

The present invention has been described with reference to the embodiments using specific terms. However, the above-described embodiments represent only mechanisms or applications of the present invention. Accordingly, various modifications and changes may be made without departing from the spirit of the present invention.

The invention claimed is:

1. A control circuit for a driving inverter for a fluorescent lamp, comprising:

a reference voltage source which generates a predetermined reference voltage;

a pulse modulator which receives a feedback voltage that corresponds to a current flowing through the fluorescent lamp, and generates a pulse signal having a duty ratio adjusted such that the feedback voltage approaches the reference voltage; and a driver which drives a switching circuit according to the pulse signal so as to supply a switching voltage to a transformer provided in the form of a component external to the control circuit, wherein the reference voltage source comprises:

a first current source which generates a first current;

a first current mirror circuit which has a plurality of output terminals, which duplicates the first current, and outputs a plurality of first duplicated currents via the plurality of output terminals;

a plurality of first switches respectively provided on paths for the plurality of first duplicated currents;

a converting resistor, one terminal of which is set to a fixed electric potential, and which is provided on a path for the plurality of first duplicated currents output from the first current mirror circuit; and a decoder circuit which receives a control signal from an external circuit, and controls the ON/OFF operations of the plurality of first switches according to the control signal, and wherein the control circuit outputs, as the reference voltage, a voltage that corresponds to a voltage drop that occurs at the converting resistor.

2. A control circuit according to claim 1, wherein the first current source includes:

a first resistor, one terminal of which is set to a fixed electric potential;

a first transistor, one terminal of which is connected to the other terminal of the first resistor; and a first operational amplifier, of which one input terminal is connected to the aforementioned other terminal of the first resistor, and the other input terminal is used to receive a predetermined reference voltage, and of which the output terminal is connected to the control terminal of the first transistor, wherein the first resistor and the converting resistor are formed on a single semiconductor substrate in a pairing manner.

3. A control circuit according to claim 1 further including:

a second current source which generates a second current;

a second current mirror circuit which has at least one output terminal, and which duplicates the second current, and outputs at least one second duplicated current via the output terminal; and at least one second switch provided on a path for at least one second duplicated current, and wherein the second duplicated current is supplied to the converting resistor, wherein the decoder circuit controls the ON/OFF operation of the second switch, in addition to the first switch.

4. A control circuit according to claim 3, wherein the second current mirror circuit includes two output terminals, and is configured so as to generate two second duplicated currents, and wherein one of the second duplicated currents is generated in a direction that flows into the converting resistor, and the other of the second duplicated currents is generated in a direction that flows out from the converting resistor.

5. A control circuit according to claim 4, wherein the composite current obtained by combining the plurality of first duplicated currents output from the first current mirror circuit is adjusted by being switched among three current levels using the first switches, and wherein the decoder circuit is configured such that, when the composite current is to be set to a minimum value, the second switch, which is provided on a path for one of the second duplicated currents, is switched to the ON state, and when the composite current is to be set to a maximum value, the second switch, which is provided on a path for the other of the second duplicated currents, is switched to the ON state.

6. A control circuit according to claim 3, wherein the second current source includes:

a second resistor, one terminal of which is set to a fixed electric potential;

a second transistor, one terminal of which is connected to the other terminal of the second resistor; and a second operational amplifier, of which one input terminal is connected to the aforementioned other terminal of the second resistor, and the other input terminal receives a predetermined reference voltage, and of which the output terminal is connected to the control terminal of the second transistor, and wherein the second resistor is provided in the form of a chip component external to a semiconductor substrate on which the control circuit is formed.

7. A light emitting apparatus comprising:

a fluorescent lamp;

a transformer with a secondary coil connected to the fluorescent lamp;

a feedback circuit which generates a feedback voltage that corresponds to the current that flows through the fluorescent lamp; and a control circuit according to any one of claim 1 through claim 6, which receives a control signal and the feedback signal for adjusting the luminance of the fluorescent lamp, and which supplies the switching voltage to a primary coil of the transformer.

8. A display apparatus comprising:

a liquid crystal panel;

a light emitting apparatus according to claim 7, which is arranged as a backlight on the back face of the liquid crystal panel; and a host processor which outputs a control signal to the light emitting apparatus in order to adjust the luminance of the fluorescent lamp.

* * * * *